United States Patent [19]

Selman, Jr.

[11] Patent Number: 5,003,641

[45] Date of Patent: Apr. 2, 1991

[54] TOILET LID SAFETY LOCK

[76] Inventor: Willis M. Selman, Jr., Rte. 1, Box 67, West, Tex. 76691

[21] Appl. No.: 508,948

[22] Filed: Apr. 13, 1990

[51] Int. Cl.[5] ..... A47K 13/24

[52] U.S. Cl. ..... 4/253

[58] Field of Search ..... 4/251, 253; 292/153, 292/181

[56] References Cited

U.S. PATENT DOCUMENTS

| | | | |
|---|---|---|---|
| 2,698,439 | 1/1955 | Bruckner | 4/253 |
| 4,395,784 | 8/1983 | Foster | 4/253 X |
| 4,479,273 | 10/1984 | Raden et al. | 4/253 |
| 4,524,470 | 6/1985 | Grenell | 4/253 |
| 4,651,358 | 3/1987 | Logan, Jr. | 4/253 |
| 4,736,472 | 4/1988 | Buckshaw et al. | 4/253 |

*Primary Examiner*—Henry J. Recla

*Assistant Examiner*—Robert M. Fetsuga

[57] ABSTRACT

A gravity reset mechanism having a pivotable locking arm extending over a toilet lid and is affixed to a housing containing interlocking parts which permit locking and unlocking of the device. The locking arm prevents the toilet lid from being raised until a latch release lever and locking bar are repositioned thereby allowing the lid to be raised until it comes to rest against a water holding tank. As the lid is raised it lifts the unlocked locking arm to a position between it and the water holding tank. The locking arm is counter balanced so that when the toilet lid is lowered, the locking arm "free falls" with it until it reaches a 90° angle with the housing at which point gravity influences the locking bar to slide into a locking cam slot thereby relocking the device. The latch release is counter balanced and reset by gravity at the same moment.

8 Claims, 7 Drawing Sheets

3
3A
4
10
LIFT HERE
3B
2
1
7
7
7A
7A

TOILET LID SAFETY LOCK

ORIGIN OF THE INVENTION

The invention described herein was made by Willis M. Selman, Jr., a citizen of the United States, who resides at Route 1, Box 67, West, Texas, 76691.

BACKGROUND OF THE INVENTION

This invention provides a new and improved means of securing toilet lids in order to make it very difficult, if not impossible, for toddlers, young children, and pets, to gain ready entry to toilets and the unsanitary water usually contained therein.

Tragically a number of small children topple into toilets and either drown or incur brain damage each year. Few of these tragedies are reported in the news media as parents are naturally hesitant to admit that their child drowned or was brain damaged in a commode bowl.

It is difficult for a child to understand that it is okay to play in the water contained in a bathtub and yet it is not okay to play in, or drink, the water contained in a toilet bowl. Water is water to a small child.

In addition to the obvious safety considerations, toys and other items are often flushed down the toilet thereby clogging the sewer line and causing expensive repair bills.

Many people also keep medium to large size dogs and other pets in their homes for protection and companionship. Quite often these pets soon learn that the toilet bowl provides a ready source of drinking water. Even if the lid is in a down position many pets are able to raise the lid in order to drink the water.

The need for a locking device that toddlers and pets cannot operate is therefore obvious. Such a device should also be easy for older children and adults to operate.

The prior state of the art demonstrates a number of devices designed for this purpose. All seem to contain one or more features which have prevented general acceptance or wide spread use. Some are complex and expensive to produce. Others are installed in locations on the toilet bowl or lid which are inconvenient to reach, difficult to install, and hard to keep clean. Some are unsightly or could cause injury if sat upon. An acceptable device must be simple to install and easy to remove when no longer needed.

U.S. Pat. No. 3,024,472 discloses a lock for toilet seat covers which would appear to do a good job of securing a toilet lid in place. It could apparently cause injury to anyone who accidentally sat upon it.

U.S. Pat. No. 3,477,070 discloses a toilet lid lock which would seem both simple and inexpensive. It is somewhat unsightly and would require one to virtually get on their knees to unlock or lock the device.

U.S. Pat. No. 4,395,784 discloses a toilet seat and lid safety lock requiring that holes be drilled in the toilet lid to secure the device in place. It provides no means to adjust the fit of the interface hinge to lids of various thickness. It does have a spring assisted relock feature which is desirable, but not as effective and maintenance free as a gravity relock or reset, as will be later referred to in this application.

U.S. Pat. No. 4,479,273 discloses a toilet seat cover locking device which is simple and likely inexpensive to manufacture. The toilet lid must be removed to permit mounting and the lever arm does not appear long enough for adequate locking.

U.S. Pat. No. 4,561,130 discloses a toilet seat cover safety latch which is complicated, has tension springs that require adjustment. The toilet seat and lid must also be removed to allow mounting the device. It is not protected from splatter.

U.S. Pat. No. 4,651,358 discloses an apparatus for securing a pivoted member such as a toilet seat lid. This apparatus could cause injury to anyone who might sit down upon it with the lid in a closed position.

U.S. Pat. No. 4,658,447 discloses a toilet seat lock which is somewhat complicated and requires that holes be drilled in both the toilet seat and lid to facilitate mounting the device. It is not protected from splatter when the toilet is used.

U.S. Pat. No. 4,724,551 discloses a toilet seat lid lock that seems fairly simple but has a drawback in that holes must be drilled into the lid for mounting the device, and further each side must be locked or unlocked independent of the other. It offers no splatter protection.

U.S. Pat. No. 4,736,472 discloses a toilet seat latch of two embodiments. One embodiment attaches to the water circulation rim of the toilet bowl and would be difficult to keep clean, and is likely to snag on clothing when in the unlocked position. The second embodiment requires removal of the toilet seat and lid to allow the use of the same two holes in the toilet bowl rim for mounting this device. "In both embodiments, when the latch bar is lowered, it automatically relocks under the influence of gravity." Automatic relock is a desirable feature, but I would challenge its being "automatic" when the latch bar part of the device must first be lowered to permit "automatic relock under the influence of gravity." The significance of the above statement will become apparent in the claims of this application.

U.S. Pat. No. 4,763,363 discloses a toilet locking apparatus with an attachment to the front rim of the toilet bowl which could cause injury to a male if he did not sit down very carefully.

That others had devised inventions to latch or lock toilet seat lids in place was unknown to the inventor at the time of this invention.

SUMMARY OF THE INVENTION

A toilet lid safety lock which is gravity reset and self locking, is disclosed. It is thought to be the one and only of its kind known to the art.

This invention is also the only known state of the art that mounts solely to the water holding tank and requires no attachment or support from, or to, any other part of the toilet. This location places the safety latch release within easy reach from a standing position. This invention will secure a toilet lid in a closed position above a toilet seat and effectively prevent access of the toilet bowl to toddlers and small children. The unit consists of a hinged locking arm attached to either side of the housing by a locking arm pivot, said pivot being molded as part of the locking arm. Another integral part of the locking arm is the locking arm cam which is located at the housing end of the locking arm and directly adjacent to the locking arm pivots when assembled. This cam is slotted to accommodate the locking bar when in a locked configuration. The locking arm is counter balanced to allow it to fall approximately ninety degrees when the toilet lid is lowered. The locking bar is then simultaneously caused by gravity to fall into a locked position within the slot of the locking arm cam. This thereby holds the locking arm in a locked position just above and in the same plane as the lowered toilet lid. (The unit is designed to be installed while in a locked configuration, therefore the movement from unlocked to locked position has been described first.)

The safety latch release is also counterbalanced in order that it will automatically engage and assume its blocking position when the locking bar falls into place blocking the movement of the locking arm cam. The safety latch release is held in place by the safety latch pivot pin which is an integral part of the real cover. The housing and all other parts should be molded from a tough, "memory retaining" plastic such as Lexan 940 or equivalent. The unit is attached to the water holding tank by means of double faced hook and loop type fasteners such as those under the trademark VELCRO, one side of which is permanently affixed to the housing after it is assembled together with the other parts. The peel off side of the hook and loop fastener strip is removed and the unit is then centered and pressed in place on the lower face of the water holding tank. The safety latch release and the locking bar have raised arrows indicating the direction of movement to unlock the unit. Moving the safety latch release to the left releases the locking bar allowing it and the toilet lid to be raised at the same time. When the lid, or lid and seat, are in a raised position and leaning against the water tank, the lock is held by the toilet lid in an unlocked position and also protected from splatter by the raised lid. When the lid is lowered the counter balanced locking arm, under the influence of gravity, and the locking bar, under the influence of gravity, will come down with the lid and drop back into a locked configuration. An alternate means of securing the unit in place would involve the use of adjustable belts or straps which would pass through the back of the housing unit and around the water holding tank. This means of attachment is not shown in the drawings. It is taken for granted that the toilet lid safety lock described herein is exemplary and that various changes and/or modifications can be made without departing from the scope of the claimed invention. It is also obvious that the basic principle of the use of a gravity operated self locking cam and locking bar have other applications to which they could be applied.

DESCRIPTION OF THE PREFERRED EMBODIMENT

Figure 1:
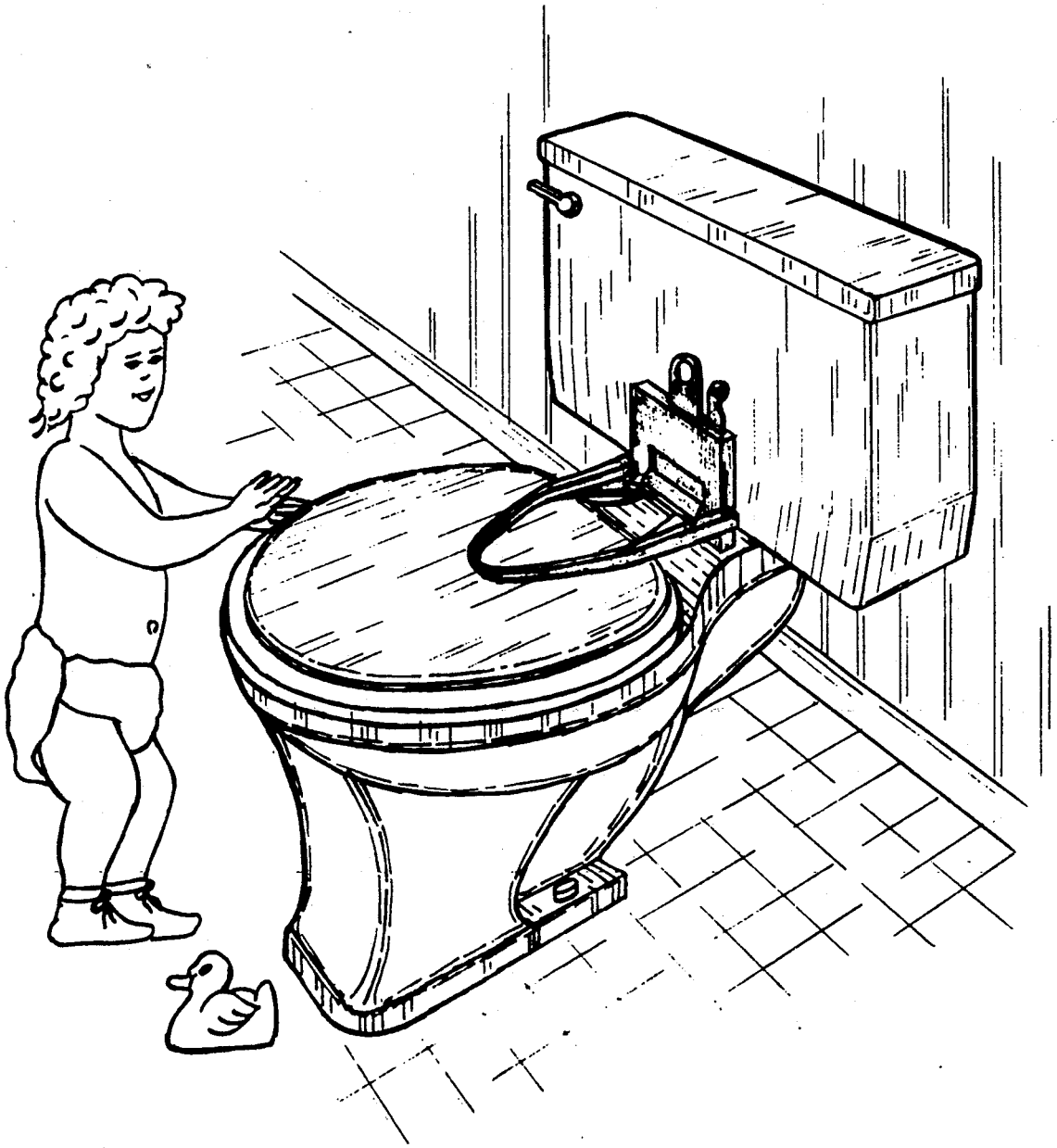
FIG. 1 is a drawing of the toilet lid safety lock as described herein shown installed and in a locked configuration.
Figure 2:
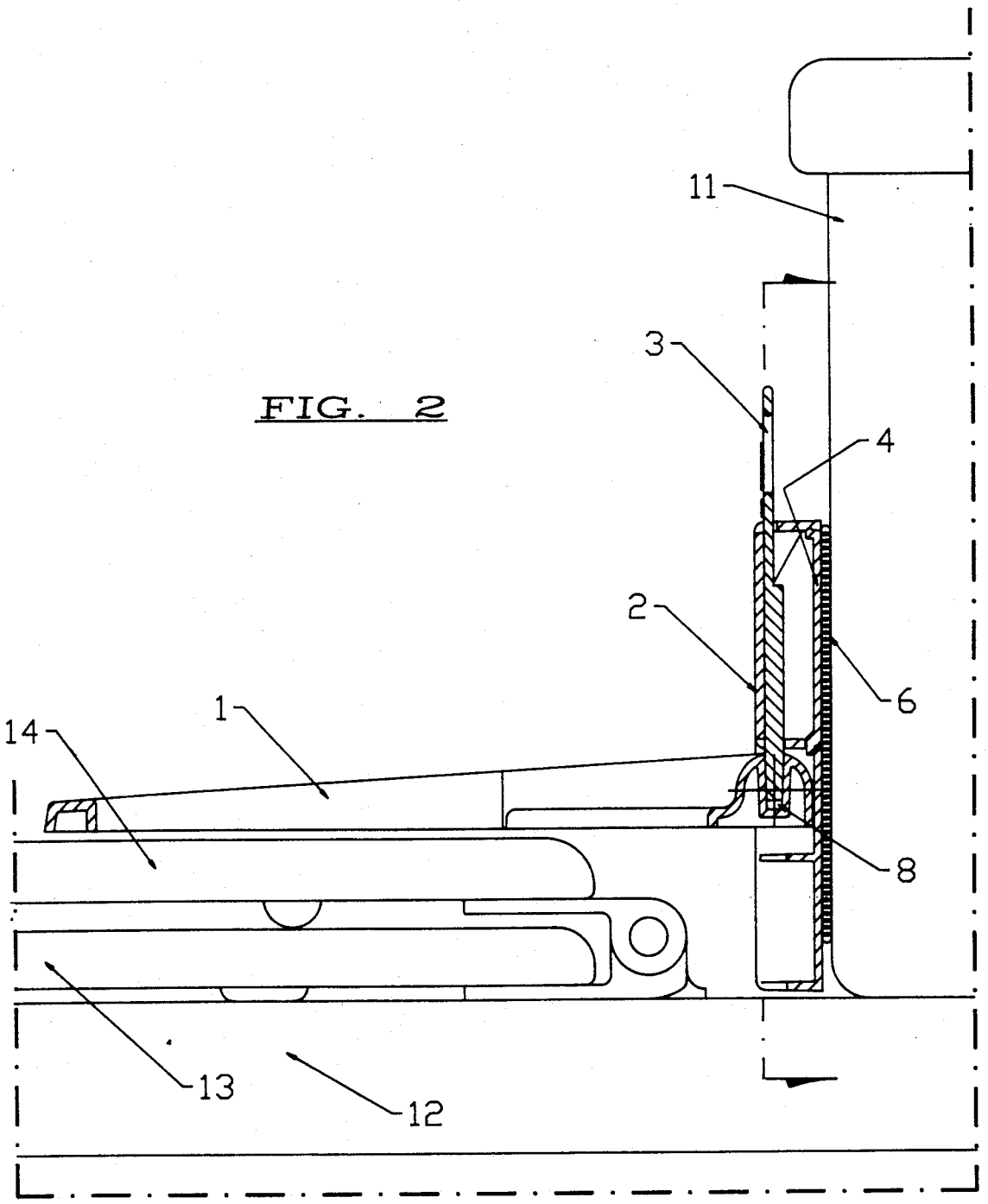
FIG. 2 is a cut away side view of the invention showing t attached to the water holding tank with double faced Velcro, and showing the locking bar engaged in the locking cam slot.
Figure 3:
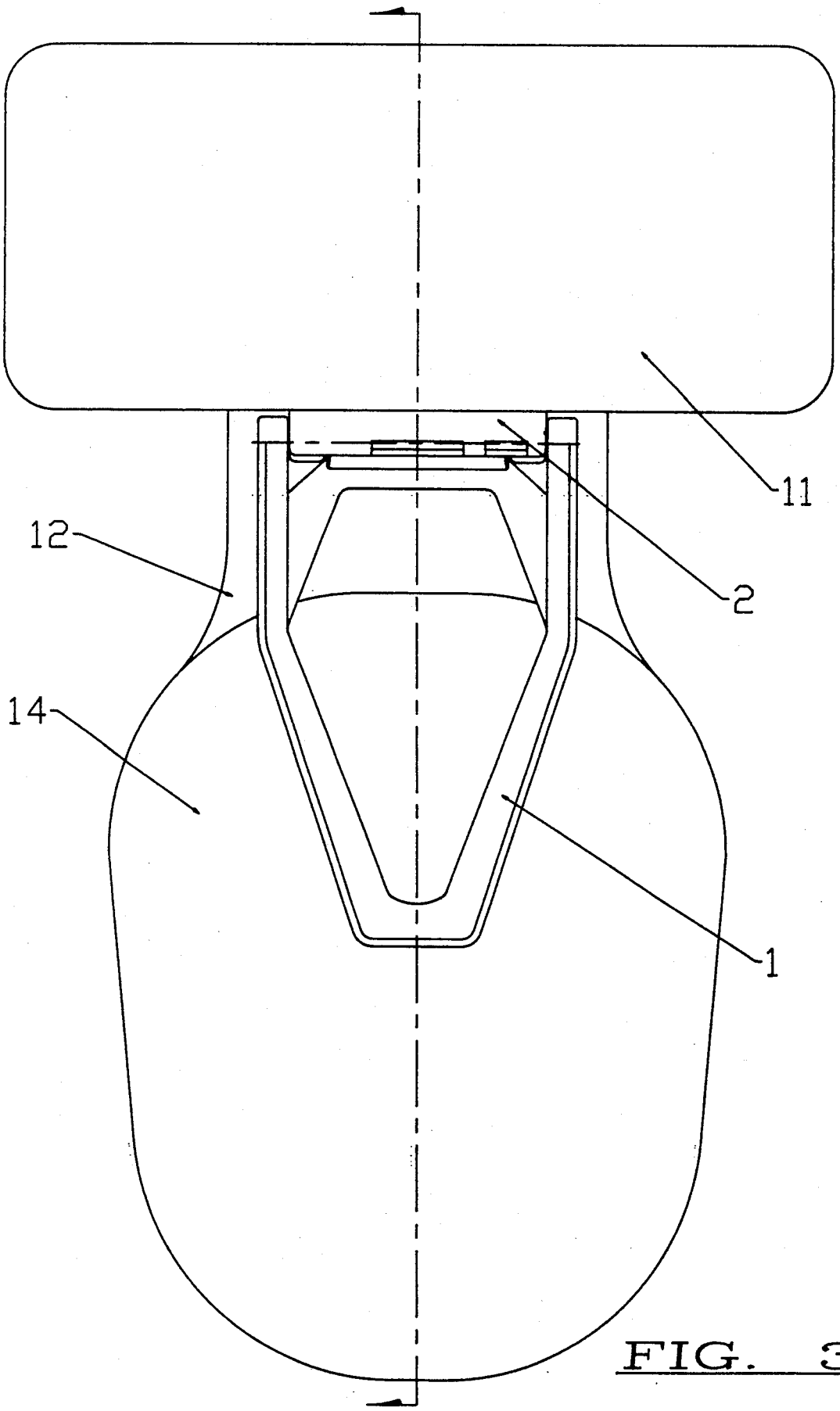
FIG. 3 is a view looking down on the invention from above and showing it attached to the water holding tank in a locked configuration.
Figure 4:
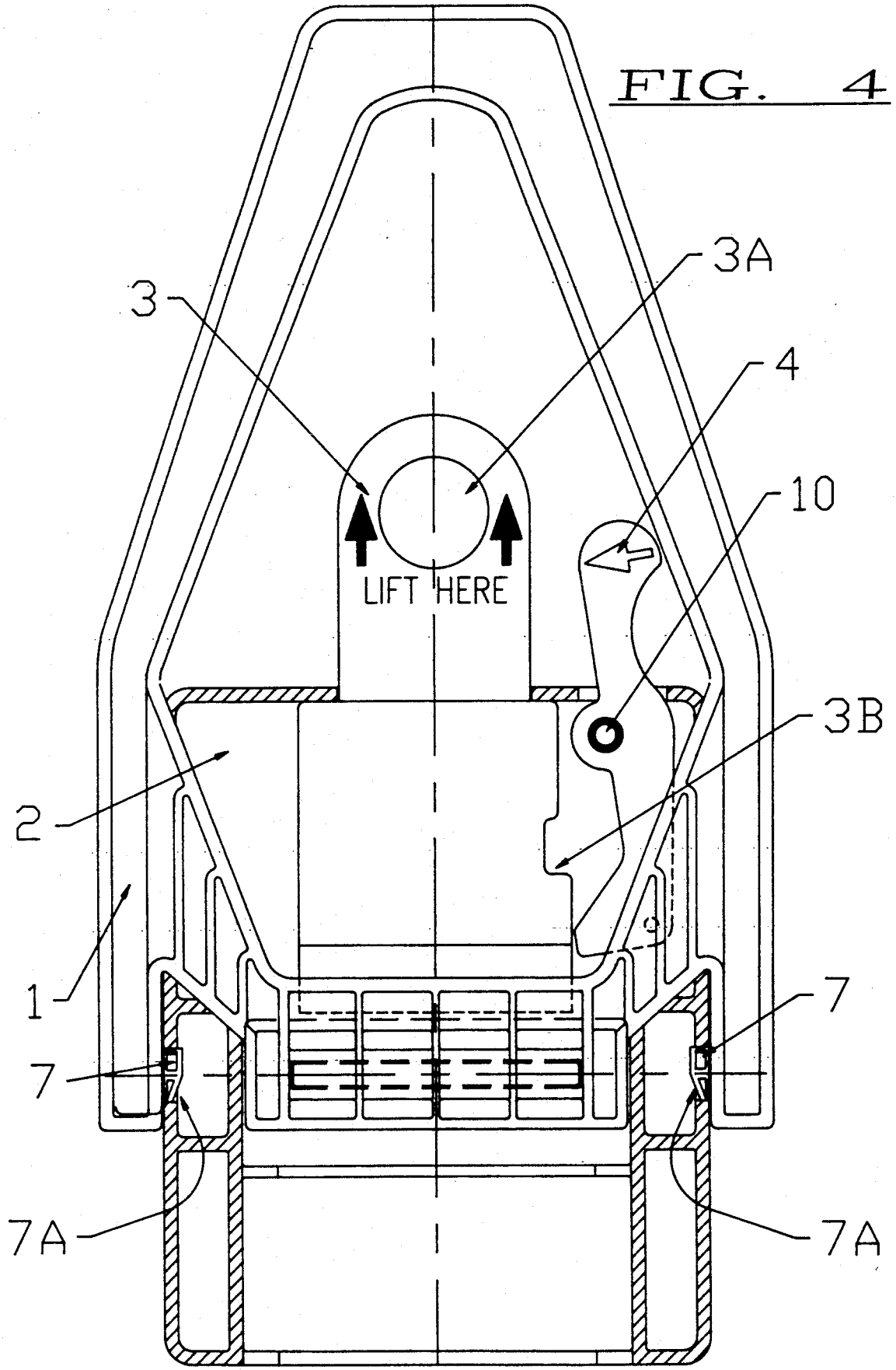
FIG. 4 is a cut away drawing of the invention showing all the moveable parts with the release lever disengaged, the locking bar fully raised, and the locking arm in the raised, unlocked, position.
Figure 5:
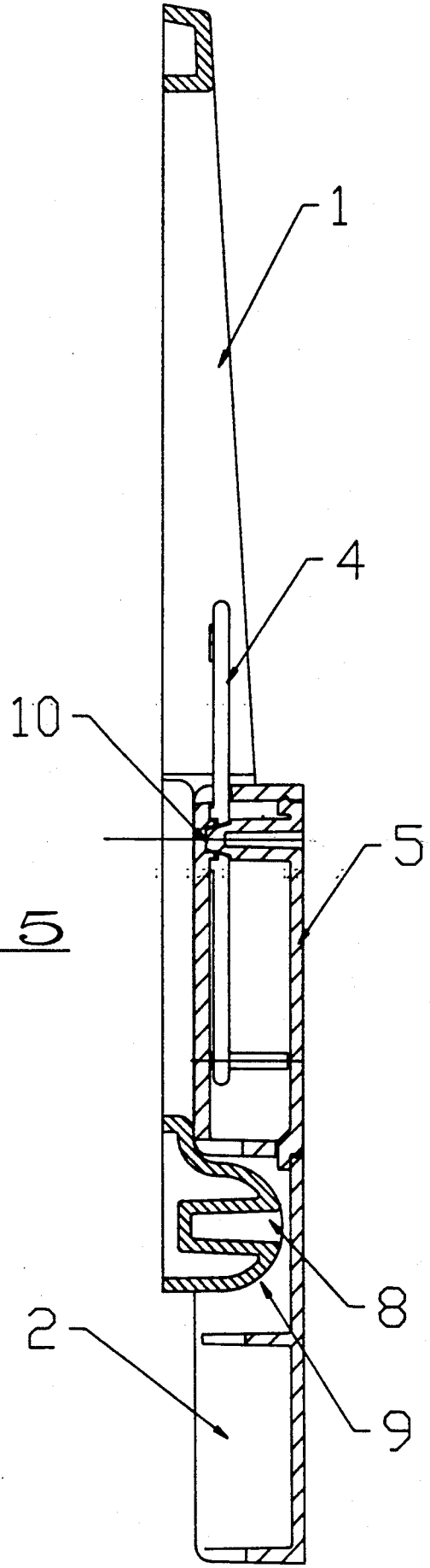
FIG. 5 is a cut away view of the device from the side in unlocked configuration, showing the raised counter balanced locking arm, the release lever, the housing, the rear cover, and the release lever pivot pin holding the release lever in place, and the locking cam and locking cam slot.
Figure 6:
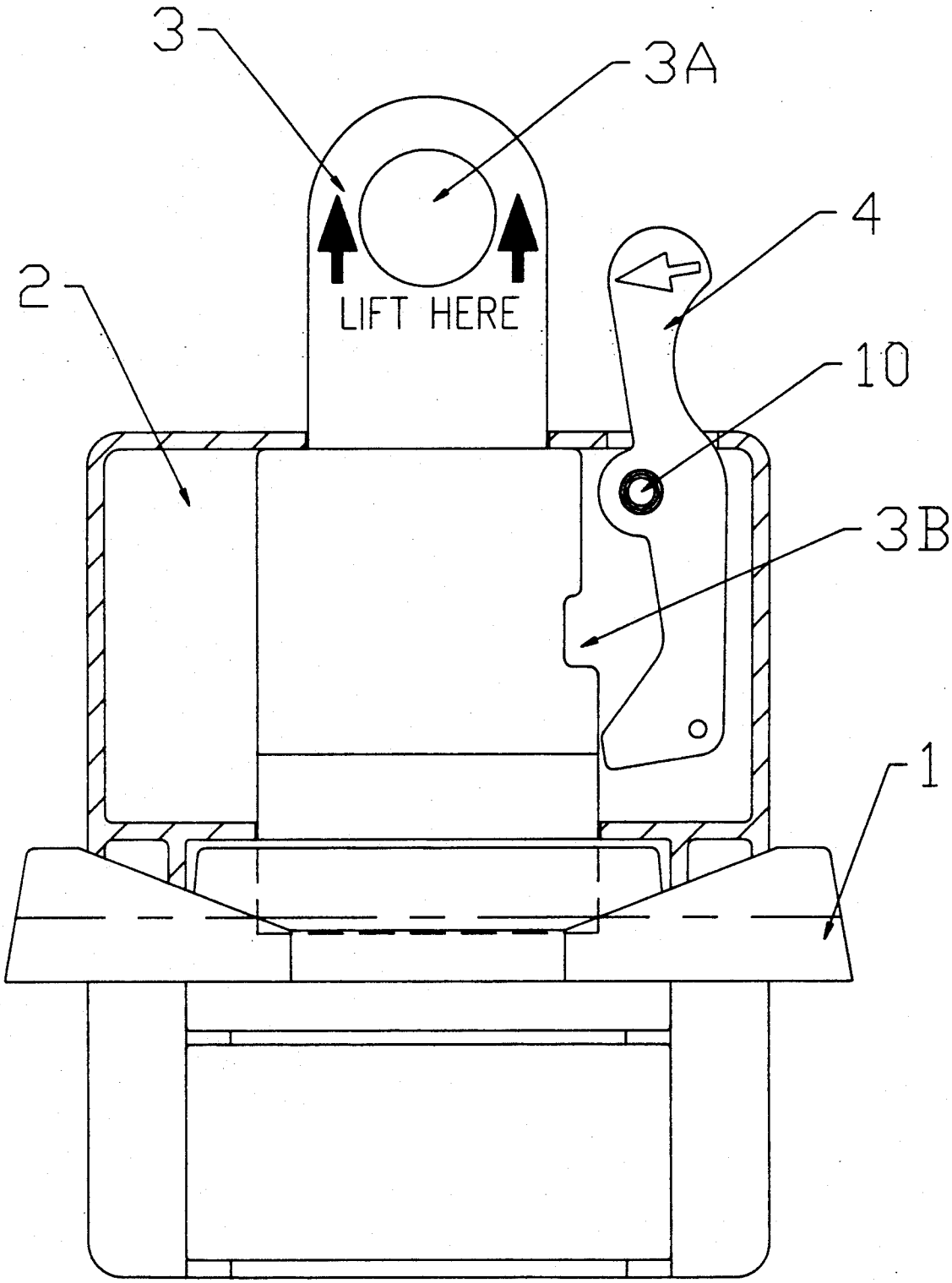
FIG. 6 is a frontal view with the upper housing face removed to show the release lever disengaged from the locking notch, the locking bar disengaged, the locking arm ready to be raised, and the upper part of the locking bar together with the locking bar lift hole. Also shown is the release lever pivot pin.
Figure 7:
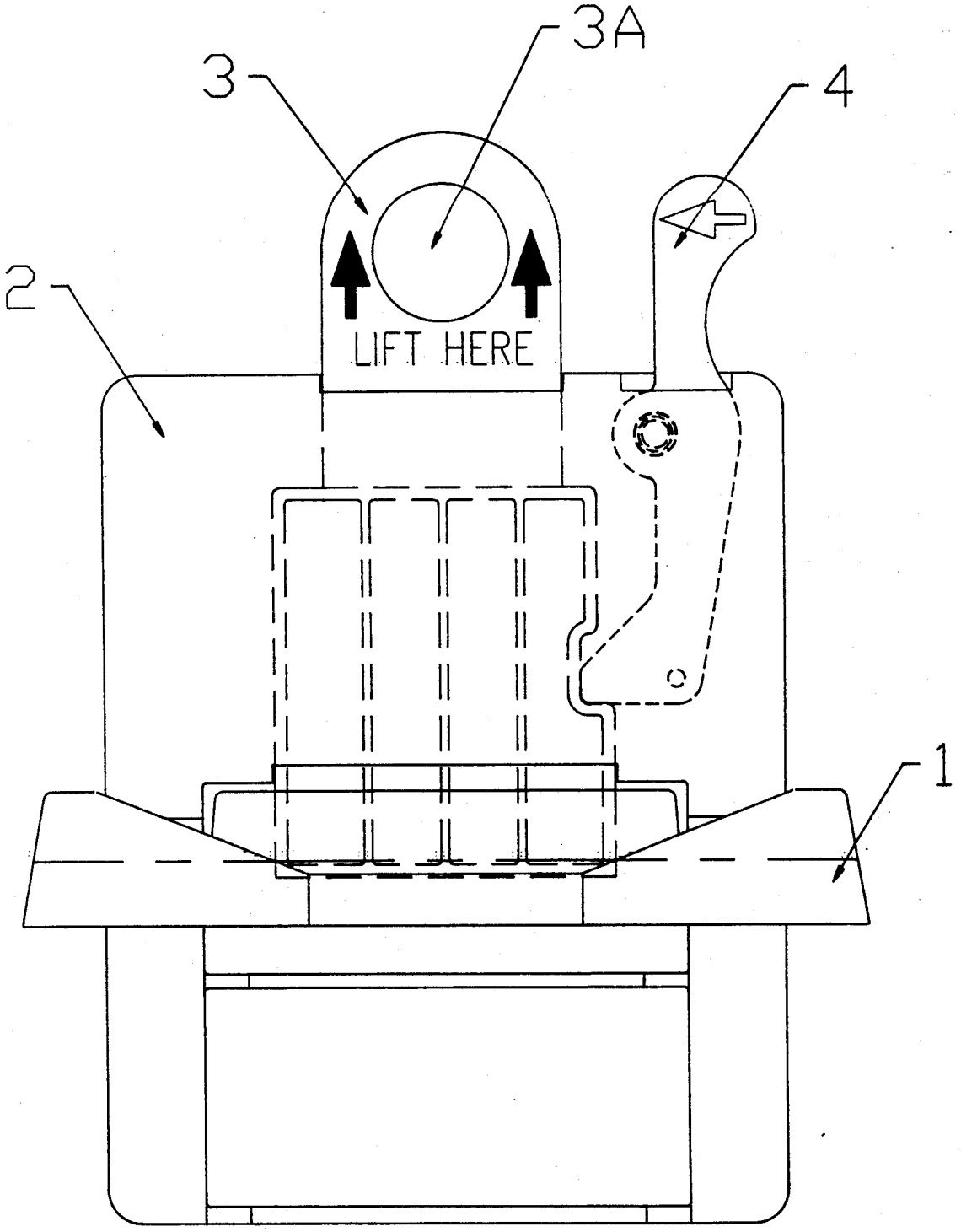
FIG. 7 is a full frontal view of the device showing the release lever engaged in the background thereby preventing the locking bar from being disengaged from the locking cam. The locking arm being in its locked configuration, it can not move. Also shown in the background is the structural rib configuration of the locking bar.

The toilet lid safety lock described in this invention is best understood by referring to drawings numbered FIG. 1 through FIG. 7. In FIG. 1 there is shown a more or less conventional toilet comprised of a water filled bowl, a pivoted hinged seat, covered by a pivoted hinged lid. On the rear of the bowl is mounted a water holding tank, the purpose of which is to resupply the bowl with water when the toilet is flushed. The present invention is shown mounted to the water holding tank in the proper position in a locked configuration thereby preventing said toilet lid or seat from being raised unless the latching mechanism is released, thereby controlling access to the toilet bowl. FIG. 2 shows the locking arm 1, being held in a locked position over the lid 14, the housing 2, being firmly and securely attached to the water holding tank 11, by the double faced hook and loop Velcro backing 6, and the locking bar 3, is snugly seated in the locking cam slot 8. Also shown is the toilet seat 13, and the toilet bowl 12. FIG. 3 shows the locking arm 1, in a locked position over the lid 14. The housing 2, is shown attached to the water holding tank 11. The toilet bowl 12, is also shown. FIG. 4 shows the toilet seat safety latch in its unlocked configuration. The locking arm 1, has its locking arm pivots 7, snugly seated in the pivot holes 7A, of the housing 2. The release lever 4, has been disengaged from the locking notch 3B, by moving the exposed portion of the lever to the left so that it pivots freely on its release lever pivot pin thereby allowing the locking bar 3, to be lifted by means of its lift hole 3A. This upward movement frees the locking arm 1, to move upward with the lid as it is raised. The lid is leaned against the water holding tank in the customary manner thereby holding the latch in its unlocked configuration and protecting it from splatter. FIG. 5 presents a side view of the device in the unlocked mode showing the locking arm 1, resting against the housing 2. Shown also is a cross section of the locking cam 9, and the locking cam slot 8. The manner by which the release lever pivot pin 10, is molded as a part of the rear cover 5, is shown, as well as the manner in which said pivot pin 10, holds the release lever 4, in place. FIG. 6 presents a front view of the device with the release lever 4, having been disengaged from the lock notch 3B, and the locking bar 3, having been raised by means of the lift hole 3A, the locking bar 1, is now released. FIG. 7 reflects a locked position, with locking bar 3, showing rib structure. Having described the various drawings and parts, it would now seem logical to describe the sequence of operational steps using the same numbers as appear on the drawings.

An adult or older child approaches a toilet equipped with this device. The release lever 4, is pushed to the left in the direction indicated by the raised arrow. This can usually be done with the little finger of the right hand. The right thumb or index finger is simultaneously inserted into the lift hole 3A, of the locking bar 3 and raised upward approximately ¾ of an inch. This movement frees the locking arm and the lid 14, is grasped by the fingers of the left hand and raised to its customary position against the water holding tank 11, thereby holding the locking arm 1, out of the way and protected until the lid 14, is lowered.

When the lid 14, is lowered, the counter balanced locking arm 1, moves downward with gravity assist. The locking bar 3, is riding on the rounded portion of the locking cam 9. When the locking arm has descended to a 90° angle with the housing 2, the locking cam slot 8, aligns with the locking bar 3, and the force of gravity drops the locking bar 3, into the locking cam slot 8, securely and automatically locking the locking arm 1, in place over the toilet lid 14.

The release lever 4, is also counter balanced in such a manner so that as the locking bar 3, slides by and the lock notch 3B arrives, the lower part of the release lever is moved by gravity to the left and engages lock notch 3B, thereby blocking the locking bar 3, from being raised until a new release sequence is initiated. No part of the device itself has been touched to accomplish relock and reset. The Inventor thus believes, after a lengthy search of the prior art, that this device is the one and only gravity relock and reset toilet lid safety latch known to the art.

The device is specifically designed to be injection molded using a high quality, "memory retentive" plastic such as Lexan 940 or equivalent. All parts are plastic. No screws or metal, nothing to rust in a high humidity bathroom. No tools required to install.

It is apparent that various modifications or changes may be made without changing the scope of the Invention..

Having established the preferred embodiment of the present invention, I claim the following:

1. A toilet lid safety lock for use with a toilet having a water holding tank, a bowl and a seat and a lid pivotally attached to the bowl, the toilet lid safety lock comprising:

a substantially rectangular hollow housing having opposing side edges, a top edge, a front face and a rear face;

means for releasably securing said rear face of said housing to a front face of the toilet tank;

a substantially V-shaped counterbalanced locking arm having the free ends thereof pivotally attached to said side edges of said housing, said locking arm including a rigid bridging portion connecting the legs thereof and spaced from the free ends, said bridging portion having a lock receiving portion extending into said housing through an opening in the from face thereof;

a locking bar slidably mounted in said housing and having a handle portion and a locking portion extending into said housing through a slot in said top edge thereof and adapted to be received in said lock receiving portion, said locking bar including a locking notch formed in one edge thereof;

a counterbalanced release lever pivotally attached to said housing, said release lever having a handle portion and an engaging portion extending into said housing through a slot in said top edge thereof, said engaging portion adapted to be engaged in said locking notch of said locking bar;

said locking arm being mounted on said housing such that it would be held in a raised position against the toilet tank by the raised toilet lid and would fall to a substantially horizontal position extending over the lid when the lid is lowered, said horizontal position of said locking arm enabling said locking bar to fall with said locking portion thereof entering said lock receiving portion of said locking arm and said engaging portion of said release lever entering said locking notch, thereby locking the toilet lid in a closed position.

2. The safety lock as defined in claim 1, wherein said locking bar has a lift hole in said handle portion thereof.

3. The safety lock as defined in claim 1, wherein said releasable securing means is hook and loop type fasteners.

4. The safety lock as defined in claim 1, wherein said rear face of said housing includes an integrally molded pivot pin on which said release lever pivots.

5. The safety lock as defined in claim 1, wherein said lock receiving portion of said locking arm has a cam slot formed therein to receive said locking portion of said locking bar.

6. The safety lock as defined in claim 5, wherein said cam slot is tapered inwardly from top to bottom thereof.

7. The safety lock as defined in claim 6, wherein said locking portion of said locking bar is tapered complementary to said cam slot.

8. The safety lock as defined in claim 1, wherein the pivots of said locking arm have a tapered configuration to enable a snap-in mounting into said housing.

* * * * *